US010765228B2

(12) United States Patent
Mikkelsen et al.

(10) Patent No.: US 10,765,228 B2
(45) **Date of Patent: *Sep. 8, 2020**

(54) BODY SUPPORT CUSHION HAVING MULTIPLE LAYERS OF PHASE CHANGE MATERIAL

(71) Applicant: Tempur World, LLC, Lexington, KY (US)

(72) Inventors: Tom Mikkelsen, Lexington, KY (US); Christopher Anthony Arendoski, Gross Pointe Farms, MI (US); Stephen Watson Switzer, Kingsport, TN (US); Kelly Wood Chandler, Gate City, VA (US); Mohamed F. Alzoubi, Johnson City, TN (US)

(73) Assignee: Tempur World, LLC, Lexington, KY (US)

( * ) Notice: Subject to any disclaimer, the term of this patent is extended or adjusted under 35 U.S.C. 154(b) by 152 days.

This patent is subject to a terminal disclaimer.

(21) Appl. No.: 15/988,717

(22) Filed: May 24, 2018

(65) Prior Publication Data

US 2018/0263377 A1 Sep. 20, 2018

Related U.S. Application Data

(63) Continuation of application No. 14/417,702, filed as application No. PCT/US2012/048669 on Jul. 27, 2012, now Pat. No. 9,980,578.

(51) Int. Cl.
*A47C 27/15* (2006.01)
*A47C 21/04* (2006.01)
(Continued)

(52) U.S. Cl.
CPC ..... *A47C 27/15* (2013.01); *A47C 21/042* (2013.01); *A47C 21/046* (2013.01);
(Continued)

(58) Field of Classification Search
CPC ..... A47C 27/15; A47C 27/002; A47C 27/053; A47C 27/056; A47C 21/042;
(Continued)

(56) References Cited

U.S. PATENT DOCUMENTS 2,604,642 A 7/1952 Marco
2,651,788 A 9/1953 Forwood
(Continued)

FOREIGN PATENT DOCUMENTS

CH 678390 9/1991
CN 103221201 A 7/2013
(Continued)

OTHER PUBLICATIONS

AliMed Inc., Rehab-Ortho Plus, Anti-Decubitus Cushions and Pads Temper Foam, pub.#187, pp. 35-36, date unknown.
(Continued)

*Primary Examiner* — Robert G Santos
*Assistant Examiner* — Rahib T Zaman
(74) *Attorney, Agent, or Firm* — Middleton Reutlinger

(57) ABSTRACT

A body support cushion, e.g., mattress, has multiple foam layers, including a viscoelastic foam layer and a reticulated foam layer, and an outer cover. At least one of the foam layers and the outer cover each includes phase change material having latent heat properties that provide two intervals of dermal cooling.

19 Claims, 4 Drawing Sheets

(51) Int. Cl.

| | |
|---|---|
| *A47C 23/14* | (2006.01) |
| *A47C 27/00* | (2006.01) |
| *A47C 23/06* | (2006.01) |
| *A47C 23/043* | (2006.01) |
| *A47C 23/18* | (2006.01) |
| *A47C 23/20* | (2006.01) |
| *A47C 27/05* | (2006.01) |

(52) U.S. Cl.
CPC ..... *A47C 23/0433* (2013.01); *A47C 23/067* (2013.01); *A47C 23/14* (2013.01); *A47C 23/18* (2013.01); *A47C 23/20* (2013.01); *A47C 27/002* (2013.01); *A47C 27/053* (2013.01); *A47C 27/056* (2013.01)

(58) Field of Classification Search
CPC . A47C 21/046; A47C 23/0433; A47C 23/067; A47C 23/14; A47C 23/18; A47C 23/20
See application file for complete search history.

(56) References Cited

U.S. PATENT DOCUMENTS

| | | | |
|---|---|---|---|
| 2,835,313 | A | 5/1958 | Dodge |
| 2,836,228 | A | 5/1958 | Dahle |
| 2,898,975 | A | 8/1959 | Wagner |
| 3,000,020 | A | 9/1961 | Lombard et al. |
| 3,043,731 | A | 7/1962 | Hill |
| 3,047,888 | A | 8/1962 | Shecter et al. |
| 3,051,601 | A | 8/1962 | Schick |
| 3,110,042 | A | 11/1963 | Slemmons |
| 3,165,355 | A | 1/1965 | Hitchcock, Jr. et al. |
| 3,171,820 | A | 3/1965 | Volz |
| 3,608,106 | A | 9/1971 | Parramon |
| 3,639,508 | A | 2/1972 | Kambour |
| 3,730,588 | A | 5/1973 | Braun |
| 3,742,526 | A | 7/1973 | Lillard |
| 3,833,259 | A | 9/1974 | Pershing |
| 3,837,020 | A | 9/1974 | Bosch |
| 3,894,973 | A | 7/1975 | Yunan |
| 3,906,137 | A | 9/1975 | Bauer |
| 3,974,532 | A | 8/1976 | Ecchuya |
| 3,987,507 | A | 10/1976 | Hall |
| 4,031,579 | A | 6/1977 | Lamed |
| 4,086,675 | A | 5/1978 | Talbert et al. |
| 4,147,825 | A | 4/1979 | Talalay |
| 4,167,612 | A | 9/1979 | Tucker et al. |
| 4,190,697 | A | 2/1980 | Ahrens |
| 4,207,636 | A | 6/1980 | Ceriani |
| 4,253,452 | A | 3/1981 | Powers et al. |
| 4,254,991 | A | 3/1981 | Venieris |
| 4,256,096 | A | 3/1981 | Budde |
| 4,262,048 | A | 4/1981 | Mitchell |
| 4,336,621 | A | 6/1982 | Schwartz et al. |
| 4,379,856 | A | 4/1983 | Samaritter et al. |
| 4,405,681 | A | 9/1983 | McEvoy |
| 4,449,261 | A | 5/1984 | Magnusson |
| 4,580,301 | A | 4/1986 | Ludman et al. |
| 4,606,088 | A | 8/1986 | Michaelsen et al. |
| 4,690,847 | A | 9/1987 | Lassiter et al. |
| 4,706,313 | A | 11/1987 | Murphy |
| 4,736,911 | A | 4/1988 | Heitmann |
| 4,748,768 | A | 6/1988 | Jacobsen |
| 4,755,411 | A | 7/1988 | Wing et al. |
| 4,756,949 | A | 7/1988 | Spence et al. |
| 4,808,469 | A | 2/1989 | Hiles |
| 4,840,430 | A | 6/1989 | Shimada |
| 4,842,330 | A | 6/1989 | Jay |
| 4,843,662 | A | 7/1989 | Handelman |
| 4,856,118 | A | 8/1989 | Sapiejewski |
| 4,930,171 | A | 6/1990 | Frantz |
| 4,947,500 | A | 8/1990 | Seiler |
| 4,955,095 | A | 9/1990 | Gerrick |
| 4,987,156 | A | 1/1991 | Tozune et al. |
| 4,999,868 | A | 3/1991 | Kraft |
| 5,007,123 | A | 4/1991 | Salyards |
| 5,018,790 | A | 5/1991 | Jay |
| 5,022,111 | A | 6/1991 | Fenner, Sr. |
| 5,027,589 | A | 7/1991 | Gleb et al. |
| 5,031,261 | A | 7/1991 | Fenner, Sr. |
| 5,068,983 | A | 12/1991 | Marc |
| 5,077,849 | A | 1/1992 | Farley |
| 5,081,728 | A | 1/1992 | Skinner |
| 5,088,747 | A | 2/1992 | Morrison et al. |
| 5,105,491 | A | 4/1992 | Yoshiyuki et al. |
| 5,117,519 | A | 6/1992 | Thomas |
| 5,141,285 | A | 8/1992 | Park |
| 5,172,436 | A | 12/1992 | Masuda |
| 5,189,747 | A | 3/1993 | Mundy et al. |
| 5,230,947 | A | 7/1993 | Ou |
| 5,231,717 | A | 8/1993 | Scott et al. |
| 5,265,295 | A | 11/1993 | Sturgis |
| 5,294,181 | A | 3/1994 | Rose et al. |
| 5,331,750 | A | 7/1994 | Sasaki et al. |
| 5,366,801 | A | 11/1994 | Bryant |
| 5,428,852 | A | 7/1995 | Tenuta et al. |
| 5,499,460 | A | 3/1996 | Bryant |
| 5,513,402 | A | 5/1996 | Schwartz |
| 5,518,802 | A | 5/1996 | Colvin et al. |
| 5,522,106 | A | 6/1996 | Harrison et al. |
| 5,637,389 | A | 6/1997 | Colvin |
| 5,669,094 | A | 9/1997 | Swanson |
| 5,687,436 | A | 11/1997 | Denton |
| 5,741,568 | A | 4/1998 | Rudy |
| 5,747,140 | A | 5/1998 | Herklotz |
| 5,804,297 | A | 9/1998 | Colvin |
| 5,815,865 | A | 10/1998 | Washburn et al. |
| 5,836,654 | A | 11/1998 | DeBellis et al. |
| 5,851,338 | A | 12/1998 | Pushaw |
| 5,855,415 | A | 1/1999 | Lilley, Jr. |
| 5,857,749 | A | 1/1999 | DeBellis et al. |
| 5,913,774 | A | 6/1999 | Feddema |
| 5,955,188 | A | 9/1999 | Pushaw |
| 6,017,006 | A | 1/2000 | Cherubini et al. |
| 6,018,832 | A | 2/2000 | Graebe |
| 6,048,810 | A | 4/2000 | Baychar |
| 6,052,851 | A | 4/2000 | Kohnle |
| 6,061,856 | A | 5/2000 | Hoffmann |
| 6,077,597 | A | 6/2000 | Pause |
| 6,093,468 | A | 7/2000 | Toms et al. |
| 6,115,861 | A | 9/2000 | Reeder et al. |
| 6,127,010 | A | 10/2000 | Rudy |
| 6,159,574 | A | 12/2000 | Landvik et al. |
| 6,163,907 | A | 12/2000 | Larson |
| 6,192,538 | B1 | 2/2001 | Fogel |
| 6,202,239 | B1 | 3/2001 | Ward et al. |
| 6,207,738 | B1 | 3/2001 | Zuckerman et al. |
| 6,217,993 | B1 | 4/2001 | Pause |
| 6,230,444 | B1 | 5/2001 | Pause |
| 6,237,173 | B1 | 5/2001 | Schlichter et al. |
| 6,241,320 | B1 | 6/2001 | Chew et al. |
| 6,256,821 | B1 | 7/2001 | Boyd |
| 6,269,504 | B1 | 8/2001 | Romano et al. |
| 6,397,419 | B1 | 6/2002 | Mechache |
| 6,460,209 | B1 | 10/2002 | Reeder et al. |
| 6,481,033 | B2 | 11/2002 | Fogel |
| 6,503,976 | B2 | 1/2003 | Zuckerman et al. |
| 6,514,362 | B1 | 2/2003 | Zuckerman et al. |
| 6,541,094 | B1 | 4/2003 | Landvik et al. |
| 6,578,220 | B1 | 6/2003 | Smith |
| 6,598,251 | B2 | 7/2003 | Habboub et al. |
| 6,601,253 | B1 | 8/2003 | Tarquino |
| 6,602,579 | B2 | 8/2003 | Landvik |
| 6,660,667 | B2 | 12/2003 | Zuckerman et al. |
| 6,662,393 | B2 | 12/2003 | Boyd |
| 6,687,933 | B2 | 2/2004 | Habboub et al. |
| 6,687,935 | B2 | 2/2004 | Reeder et al. |
| 6,689,466 | B2 | 2/2004 | Hartmann |
| 6,709,729 | B2 | 3/2004 | Baruch |
| 6,735,800 | B1 | 5/2004 | Salvatini et al. |
| 6,745,419 | B1 | 6/2004 | Delfs et al. |
| 6,785,923 | B2 | 9/2004 | Karafa et al. |
| 6,787,078 | B2 | 9/2004 | English et al. |
| 6,793,856 | B2 | 9/2004 | Hartmann et al. |

(56) References Cited

U.S. PATENT DOCUMENTS

| | | | | |
|---|---|---|---|---|
| 6,866,915 | B2 | 3/2005 | Landvik | |
| 6,893,695 | B2 | 5/2005 | Baychar | |
| 6,952,852 | B2 | 10/2005 | Reeder et al. | |
| 6,981,341 | B2 | 1/2006 | Baychar | |
| 7,036,172 | B2 | 5/2006 | Torbet et al. | |
| 7,059,001 | B2 | 6/2006 | Woolfson | |
| 7,065,816 | B2 | 6/2006 | McGettigan | |
| 7,103,933 | B2 | 9/2006 | Gladney et al. | |
| 7,125,816 | B1 | 10/2006 | Baychar | |
| 7,135,424 | B2 | 11/2006 | Worley et al. | |
| 7,147,911 | B2 | 12/2006 | Baychar | |
| 7,155,765 | B2 | 1/2007 | Fogg | |
| 7,160,612 | B2 | 1/2007 | Magill et al. | |
| 7,200,884 | B2 | 4/2007 | Wright | |
| 7,241,497 | B2 | 7/2007 | Magill et al. | |
| 7,244,497 | B2 | 7/2007 | Hartmann et al. | |
| 7,311,209 | B2 | 12/2007 | Bentz et al. | |
| 7,314,840 | B2 | 1/2008 | Baychar | |
| 7,323,243 | B2 | 1/2008 | Baychar | |
| 7,469,437 | B2 * | 12/2008 | Mikkelsen | A47C 7/742 5/740 |
| 7,507,468 | B2 | 3/2009 | Landvik et al. | |
| 7,563,398 | B2 | 7/2009 | Hartmann et al. | |
| 7,579,078 | B2 | 8/2009 | Hartmann et al. | |
| 7,666,500 | B2 | 2/2010 | Magill et al. | |
| 7,666,502 | B2 | 2/2010 | Magill et al. | |
| 7,790,283 | B2 | 9/2010 | Hartmann et al. | |
| 7,836,722 | B2 | 11/2010 | Magill et al. | |
| 8,025,964 | B2 | 9/2011 | Landvik et al. | |
| 8,034,445 | B2 | 10/2011 | Landvik et al. | |
| 8,173,257 | B2 | 5/2012 | Hartmann et al. | |
| 8,221,910 | B2 | 7/2012 | Hartmann et al. | |
| 8,404,341 | B2 | 3/2013 | Hartmann et al. | |
| 8,418,297 | B2 | 4/2013 | Mikkelsen et al. | |
| 8,569,190 | B2 | 10/2013 | Baychar | |
| 8,587,945 | B1 | 11/2013 | Hartmann et al. | |
| 8,673,448 | B2 | 3/2014 | Hartmann et al. | |
| 8,679,627 | B2 | 3/2014 | Hartmann et al. | |
| 8,881,328 | B2 | 11/2014 | Mikkelsen et al. | |
| 9,980,578 | B2 * | 5/2018 | Mikkelsen | A47C 27/15 |
| 2003/0109908 | A1 * | 6/2003 | Lachenbruch | A47C 21/046 607/96 |
| 2003/0135930 | A1 | 7/2003 | Varese et al. | |
| 2003/0186044 | A1 | 10/2003 | Sauniere et al. | |
| 2004/0074008 | A1 | 4/2004 | Martens et al. | |
| 2004/0139552 | A1 | 7/2004 | Walters, Jr. | |
| 2004/0142619 | A1 | 7/2004 | Ueno et al. | |
| 2004/0209062 | A1 | 10/2004 | Sebag | |
| 2005/0034330 | A1 | 2/2005 | Baychar | |
| 2005/0084667 | A1 | 4/2005 | Landvik et al. | |
| 2005/0140199 | A1 | 6/2005 | Kang et al. | |
| 2005/0210595 | A1 | 9/2005 | Di Stasio et al. | |
| 2005/0214501 | A1 | 9/2005 | Baychar | |
| 2006/0031996 | A1 | 2/2006 | Rawls-Meehan | |
| 2006/0112491 | A1 * | 6/2006 | Buehner | A01K 1/0157 5/691 |
| 2006/0260059 | A1 | 11/2006 | Apperson et al. | |
| 2006/0260060 | A1 | 11/2006 | Apperson et al. | |
| 2006/0288490 | A1 | 12/2006 | Mikkelson et al. | |
| 2006/0288491 | A1 | 12/2006 | Mikkelsen | |
| 2007/0141940 | A1 | 6/2007 | Baychar | |
| 2008/0313815 | A1 * | 12/2008 | Guesquiere | A47C 27/15 5/690 |
| 2009/0165213 | A1 | 7/2009 | Collins et al. | |
| 2009/0172887 | A1 | 7/2009 | Landvik | |
| 2009/0288259 | A1 | 11/2009 | Lean et al. | |
| 2009/0293199 | A1 * | 12/2009 | Landvik | A47C 27/15 5/740 |
| 2010/0009112 | A1 | 1/2010 | Baychar | |
| 2010/0263128 | A1 * | 10/2010 | Lean | A47C 27/14 5/636 |
| 2010/0269241 | A1 | 10/2010 | Baychar | |
| 2011/0000106 | A1 | 1/2011 | Baychar | |
| 2011/0252562 | A1 | 10/2011 | Chandler et al. | |
| 2011/0256380 | A1 | 10/2011 | Chandler et al. | |
| 2011/0289683 | A1 | 12/2011 | Chandler et al. | |
| 2011/0289689 | A1 | 12/2011 | Mikkelsen et al. | |
| 2012/0023664 | A1 * | 2/2012 | Joo | A47C 21/042 5/421 |
| 2012/0263910 | A1 | 10/2012 | Baychar | |
| 2013/0224458 | A1 * | 8/2013 | Bolliou | A47C 27/15 428/215 |
| 2013/0273300 | A1 | 10/2013 | Baychar | |
| 2014/0120310 | A1 | 5/2014 | Baychar | |
| 2014/0304921 | A1 | 10/2014 | Mikkelsen | |
| 2014/0325758 | A1 | 11/2014 | Chandler et al. | |
| 2015/0031258 | A1 | 1/2015 | Baychar | |
| 2015/0033474 | A1 | 2/2015 | Mikkelsen et al. | |
| 2015/0040327 | A1 | 2/2015 | Mikkelsen | |

FOREIGN PATENT DOCUMENTS

| | | | |
|---|---|---|---|
| DE | 1654301 | | 3/1971 |
| DE | 2235818 | | 1/1974 |
| DE | 3321720 | | 12/1984 |
| DE | 3803448 | | 8/1988 |
| DE | 10037888 | | 6/2002 |
| DE | 202004003248 | | 5/2004 |
| DE | 20023506 | | 8/2004 |
| DE | 202004004701 | | 8/2004 |
| DE | 202010006700 | | 8/2010 |
| EP | 0338463 | | 10/1989 |
| EP | 0486016 | | 5/1992 |
| EP | 0713900 | | 5/1996 |
| EP | 0718144 | | 6/1996 |
| EP | 0777988 | | 6/1997 |
| EP | 0782830 | | 7/1997 |
| EP | 0962171 | | 12/1999 |
| EP | 1192925 | | 4/2002 |
| EP | 1430814 | | 6/2004 |
| EP | 2253653 | A1 | 11/2010 |
| FR | 2598910 | | 11/1987 |
| FR | 2795371 | | 12/2000 |
| FR | 2818187 | | 6/2002 |
| FR | 2848817 | | 6/2004 |
| GB | 2244000 | | 11/1991 |
| GB | 2290256 | | 12/1995 |
| GB | 2297057 | | 7/1996 |
| GB | 2410892 | | 8/2005 |
| IT | 1238272 | | 7/1993 |
| IT | 224783 | | 6/1996 |
| JP | 62183790 | | 8/1987 |
| JP | 3128006 | | 5/1991 |
| JP | 2006296461 | | 11/2006 |
| WO | 85/04150 | | 9/1985 |
| WO | 9324241 | | 12/1993 |
| WO | 98/50251 | | 11/1998 |
| WO | 01/28388 | | 4/2001 |
| WO | 03/072391 | | 9/2003 |
| WO | 2004002729 | A1 | 1/2004 |
| WO | 2004/089682 | | 10/2004 |
| WO | 2005/011442 | | 2/2005 |
| WO | 2005/046988 | | 5/2005 |
| WO | 2010/075300 | | 7/2010 |
| WO | 2013112840 | A1 | 8/2013 |
| WO | 2014/204934 | | 7/2014 |
| WO | 2014/204934 | | 12/2014 |
| WO | 2015/012859 | | 1/2015 |

OTHER PUBLICATIONS

AliMed Inc., Rehab-Orthopedic, Occupational Therapy, About T-Foam and Temper Foam—New Dimensions in Sitting Comfort, Stability, and Safety, pp. 46-47, 1988 Edition.

AliMed Inc., Lower Extremities Catalog, Materials Listing, pp. 34-35, 1989 Edition.

AliMed Inc., Physical Rehabilitation and Orthopedics, Catalog #1039, C71, C72, C81, C161, C164-167, 1990.

AliMed Inc., Self-Help Aids Catalog, Combo T-Foam Cushions Fit Everyone, D68, 1990.

(56) References Cited

OTHER PUBLICATIONS

AliMed, Inc., Lower Extremities Orthoses and Accessories, Materials Index and T-Foam and T-Stick Padding, B10-B11, & B21, 1990-91.
ASTM, "Standard Methods of Testing Flexible Cellular Materials-Slab Urethane Foam", American National Standard J151, American National Standards Institute, pp. 330-346, approved May 28, 1975.
Carter, Tom, "Ex-Horseman Marketing Foam Pillows, Mattresses", At Home, Gadgets, Lexington Herald-Leader, Lexington, KY, Jul. 1, 1995.
Brookstone Company, Inc., Brookstone Collection, Catalog, Printed in the United States of America, 15 pages, date unknown.
Brookstone Company, Inc., Brookstone Collection, Holiday Catalog, Printed in the United States of America, 16 pages, Holiday 1993.
Brookstone, Explore the Wonders, Holidays at Brookstone, Catalog, 16 pages, date unknown.
Brookstone Company, Inc., Brookstone Collection, Catalog, Printed in the United States of America, p. 49, C294 B-1, date unknown.
Brookstone Company, Inc., Brookstone Collection, Catalog, Printed in the United States of America, pp. 1-63, C294 B-1, date unknown.
Brookstone Company, Inc., Brookstone, Hard-To-Find Tools Catalog, Printed in the United States of America, pp. 1-67, T181-D2, date unknown.
Brookstone Company, Inc., Brookstone Collection, Spring Catalog, Printed in the United States of America, pp. 1-47, c-1-94, date unknown.
Brookstone Company, Inc., Brookstone Collection, Catalog, Printed in the United States of America, pp. 1-63, C294 A-1, date unknown.
Brookstone Company, Inc., Brookstone, Hard-To-Find Tools Catalog, Printed in the United States of America, pp. 1-67, T181-A6, date unknown.
Brookstone Company, Inc., Brookstone Collection, Catalog, Printed in the United States of America, pp. 1-47, c-2-94, date unkown.
Brookstone Company, Inc., Brookstone Collection, Doodads for Whatever Dads Do, Father's Day Catalog, Printed in the United States of America, pp. 1-47, c-1-94, date unknown.
Brookstone Company, Inc., Brookstone, Hard-To-Find Tools Catalog, Printed in the United States of America, pp. 1-63, T-5-94 D1, date unknown.
Brookstone Company, Inc., Brookstone, Hard-To-Find Tools Catalog, Printed in the United States of America, pp. 1-67, T181-B1, date unknown.
Brookstone Company, Inc., Brookstone Collection, Catalog, Printed in the United States of America, pp. 1-63, C294 E-1, date unknown.
Brookstone Company, Inc., Brookstone, Hard-To-Find Tools Catalog, Printed in the United States of America, pp. 1-63, T-5-94 A4, date unknown.
Brookstone Company, Inc., Brookstone, Hard-To-Find Tools Catalog, Printed in the United States of America, pp. 1-63, T-5-94 A2, date unknown.
Brookstone Company, Inc., Brookstone, Hard-To-Find Tools Catalog, Printed in the United States of America, pp. 1-63, T-4-94 A2, date unknown.
Brookstone Company, Inc., Brookstone, Hard-To-Find Tools Catalog, Printed in the United States of America, pp. 1-63, T-4-94 B1, date unknown.
Brookstone Company, Inc., Brookstone Collection, Catalog, Printed in the United States of America, pp. 1-63, C294 C-1, date unknown.
Brookstone Company, Inc., Brookstone, Hard-To-Find Tools Catalog, pp. 1-63, date unknown.
Brookstone Company, Inc., Brookstone, Hard-To-Find Tools Catalog, Printed in the United States of America, pp. 1-63, T-5-94 B1, date unknown.
Brookstone Company, Inc., Brookstone, Hard-To-Find Tools Catalog, Printed in the United States of America, pp. 1-63, T-5-94 C1, date unknown.
Brookstone Company, Inc., Brookstone, Hard-To-Find Tools Catalog, Printed in the United States of America, pp. 1-67, T181-C1, date unknown.
Technical Support Package, "Viscoelastic Foam Cushion", NASA—Ames Research Center, Tech Brief ARC-11089, Dec. 1976.
Koreska, J. et al., "A New Foam for Support of the Physically Handicapped", Biomedical Engineering, vol. 10, pp. 56-62 (Feb. 1975) (also contained within NASA Technical Support Package ARC-11089).
Singer, "Beds Should be Firm but Kind: National Back Pain Week Oct. 11-16", published by PR Newswire Europe on Sep. 29, 1993.
Spinoff 1981: An Annual Report, published by NASA, pp. 76-77, 1981.
Krouskop, T., et al., "Factors Affecting the Pressure-Distributing Properties of Foam Mattress Overlays", Journal of Rehabilitation Research and Development, vol. 23, No. 3, pp. 33-39, Jul. 3, 1986.
Peterson, M. et al., "Measurement and Redistribution of Excessive Pressures During Wheelchair Sitting", Physical Therapy, vol. 62, No. 7, pp. 990-994, Jul. 1982.
Hayes, M. et al., "Spontaneous Motor Activity is Affected by Sleep Surface Quality in Children", Sleep Research, vol. 23, p. 126, 1994.
Haggerty, James, J., "Foaming Cushioning", Spinoff, published by NASA, pp. 68-69, Aug. 1988.
AliMed, Inc., Cushions, Catalog #683, pp. 53-58, Jun. 14, 1983.
Dynamic Systems, Inc., Sun-Mate Seat Cushions, pp. WC00648246-250, Jan. 1, 1984.
The Comfort Store, Memory Foam Mattress Pad—Jobri BetterRest Memory Foam Mattress Topper, Available Online at: <http://www.sittincomfort.com/bemefoto.html>, 5 pages, 1994.
Tempur-Pedic Investor Relations: Investor FAQ, Available Online at: <http://phx.corporate-ir.net/phoenix.zhtml?c=176437&p=irol-faq>, 2 pages, 2006.
Office Action from U.S. Appl. No. 12/407,605 dated Feb. 17, 2010 (8 pages).
Office Action from U.S. Appl. No. 95/000,494 dated Feb. 4, 2010 (60 pages).
Office Action from U.S. Appl. No. 12/407,605, dated Nov. 12, 2010, 15 pages.
Office Action from U.S. Appl. No. 11/080,739, dated Oct. 27, 2010, 11 pages.
Office Action from U.S. Appl. No. 11/080,739, dated Apr. 14, 2011, 13 pages.
Examiner Interview Summary from U.S. Appl. No. 11/187,032, dated Nov. 4, 2010, 3 pages.
Office Action from U.S. Appl. No. 11/187,032, dated Jan. 13, 2011, 9 pages.
Office Action from U.S. Appl. No. 11/005,803, dated Jan. 3, 2011, 12 pages.
Office Action from U.S. Appl. No. 11/187,032 dated Aug. 17, 2007, 10 pages.
Office Action from U.S. Appl. No. 11/187,032 dated Mar. 19, 2008, 9 pages.
Office Action from U.S. Appl. No. 11/187,032 dated Aug. 3, 2010, 8 pages.
Office Action from U.S. Appl. No. 11/080,739 dated Sep. 23, 2005, 6 pages.
Office Action from U.S. Appl. No. 11/080,739 dated Jun. 15, 2006, 7 pages.
Office Action from U.S. Appl. No. 11/080,739 dated Mar. 9, 2007, 10 pages.
Office Action from U.S. Appl. No. 11/080,739 dated Nov. 1, 2007, 12 pages.
Webster's Dictionay, p. 1240, 1984.
Examiner's Answer for U.S. Appl. No. 11/080,739, Before the Board of Patent Appeals and Interferences, dated Aug. 6, 2008, 15 pages.
Decision on Appeal for U.S. Appl. No. 11/080,739, Before the Board of Patent Appeals and Interferences, dated Apr. 22, 2010, 13 pages.
Request for Continued Examination with Amendment/Reply for U.S. Appl. No. 11/080,739, filed Jun. 22, 2010, 12 pages.
Examiner's Answer for U.S. Appl. No. 11/187,032, Before the Board of Patent Appeals and Interferences, dated Jan. 13, 2009, 12 pages.

(56) References Cited

OTHER PUBLICATIONS

Decision on Appeal for U.S. Appl. No. 11/187,032, Before the Board of Patent Appeals and Interferences, dated Apr. 22, 2010, 10 pages.
Request for Continued Examination with Amendment/Reply for U.S. Appl. No. 11/187,032, filed Jun. 22, 2010, 11 pages.
Comments of Third Party Requester Following Patent Owqner's Response in Inter Partes Reexamination, U.S. Pat. No. 7,507,468, dated May 5, 2010, 46 pages.
Patent Owner Remarks, U.S. Pat. No. 7,507,468, dated Jun. 7, 2010, 3 pages.
Office Action from U.S. Appl. No. 11/005,803, dated Jun. 23, 2010, 10 pages.
AliMed, Inc., Catalog #1039, 1990.
Translation of DE 2 235 818, Jan. 31, 1974, 2 pages.
Written Opinion and International Search Report, USPTO, dated Mar. 25, 2013, 10 pgs.
European Patent Office, Office Action issued in corresponding Application No. 12881919.0, dated Oct. 14, 2016.
The State Intellectual Property Office of The People's Republic of China, Second Office Action issued in corresponding Application No. 201280075541.X, dated Oct. 18, 2016.

* cited by examiner

BODY SUPPORT CUSHION HAVING MULTIPLE LAYERS OF PHASE CHANGE MATERIAL

CLAIM TO PRIORITY

This continuation patent application claims priority to and benefit of, under 35 U.S.C. § 120, U.S. patent application Ser. No. 14/417,702, filed Jun. 17, 2015 and titled "Body Support Cushion Having Multiple Layers Of Phase Change Material", which is a national stage entry of PCT Application No. PCT/US2012/048669, filed on Jul. 27, 2012, the entire disclosure of which is incorporated herein by reference.

BACKGROUND OF THE INVENTION

The present invention relates generally to body support cushions such as those found in mattresses, pillows, office chairs, household furniture, ear seating, theater seating; and the like.

As is generally the case with all body support cushions, but particularly so with mattresses consisting of "memory foam" or other body conforming material, the effectiveness of the cushion in providing body support is partly a function of how well the memory foam responds to the contour of the user resting on the cushion. Body support cushions made from temperature-sensitive viscoelastic material, such as TEMPUR® material that is commercially available from Tempur-Pedic International Inc., for example, are able change shape based in part upon the temperature of the supported body part. This conformance of the cushion to the body, in effect, causes more of the body to be in contact with the body support cushion. Thus, as the cushion cradles the supported body part, more of the body part that is supported by the cushion. Since more of the body is in contact with the cushion, rather than being pushed above it, less of the body that is exposed to ambient air around the cushion. As a consequence, many users find memory foam mattresses and other memory foam cushions to "sleep hot" and, ultimately, choose other types of cushions notwithstanding the supportive benefits often associated with memory foam and similar types of body conforming cushions.

In an effort to attract users with concerns of "sleeping hot" in a memory foam mattress, many mattress manufactures have incorporated, so-called "cooler" technologies into their products. For example, many mattresses now come with covers containing latent heat storage units, such as phase change material (PCM), that provide a cool, albeit brief, dermal sensation. One such phase change material is OUTLAST®, which is commercially available from Outlast Technologies, Boulder, Colo. While the use of such PCM does provide: some cooling, it is short-lived because in relatively short order the PCM will absorb heat from the supported body part and hold that heat until the supported body part is withdrawn.

Another approach to providing a. "cooler" mattress has been in the inclusion of gel or similar material into the construction of the bed. Gel, similar to PCM, has some latent heat properties that provide a momentary dermal sensation of coolness. However, gel-like PCM, can only absorb so much heat before the gel becomes saturated and thus is no longer cool to touch. Further, once the gel is heated, it will hold that heat until the heat source, i.e., body, is removed.

Additional efforts to provide a "cooler" memory foam cushion have included the use of cooling blankets, such as the ChiliPacp'M mattress pad from Chili Technology, Mooresville, N.C. Not only to do such blankets add to the overall cost of the cushion, but they can negatively impact the feel of the cushion as well. Moreover, such blankets require a pump to circulate coolant, e.g., water, and thus incorporate electromechanical devices that can fail and render the after-market blanket inoperable.

Based at least in part upon the limitations of existing cooling technologies and the demand from some consumers for a cooler memory foam body support cushion, new body support cushions are welcome additions to the art.

SUMMARY OF THE INVENTION

The present invention is generally directed to a multi-layer foam cushion enclosed within an outer cover. Portions of the outer cover and the foam cushion comprise PCM to provide an extended cool dermal sensation to a user resting on the cushion. In some alternate embodiments of the invention, the Multi-layer foam cushion has one or more layers of viscoelastic polyurethane foam and one or more layers of high resilience (HR) foam. In yet other embodiments of the invention, one or more layers of the multi-layer construction may include reticulated viscoelastic foam.

Other objects, features, aspects, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

Figure 1:
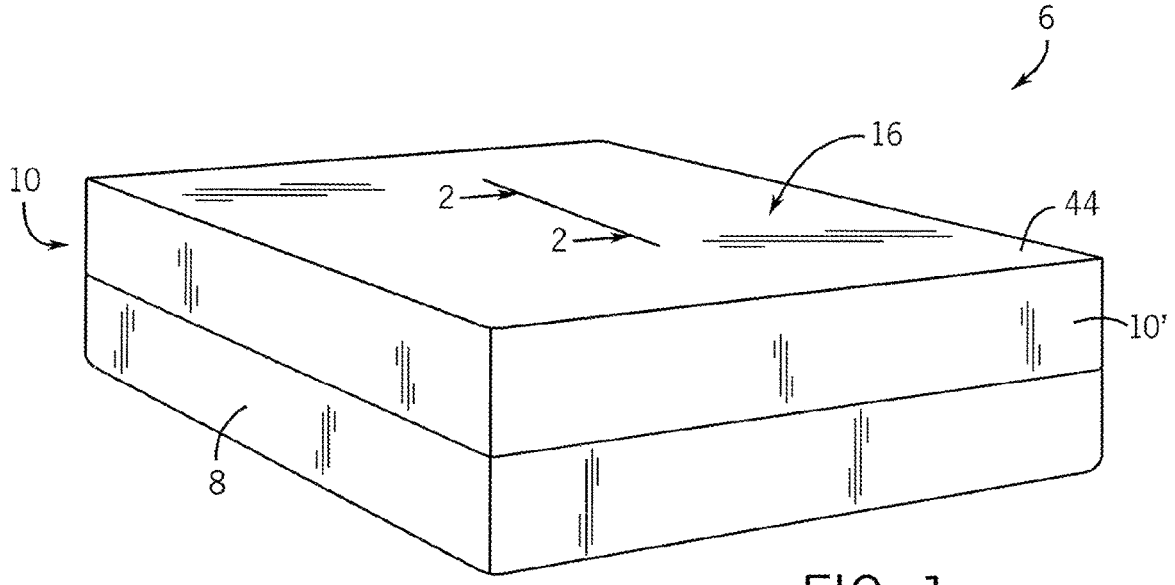
FIG. 1 is an isometric view of a sleep system having a body support cushion according on an embodiment of the invention.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. The use of "including," "comprising," or "having"

and variations thereof herein is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

DETAILED DESCRIPTION

The present invention will be described with respect to a body support cushion in the form of a mattress for use with a sleep system but it should be understood that the invention can be embodied in other types of support cushions, including but not limited to, pillows and seat cushions.

Turning, now to FIG. 1, sleep system 6 is generally comprised of a foundation 8 and a mattress 10. The foundation 8 and the mattress 10 are supported in a raised position by a frame (not shown) as known in the art. The foundation 8 is of known construction and thus will be not be described in greater detail herein; however, it should be noted that the mattress 10 could be used with other types of mattress supports, such as box springs or tables.

Figure 2:
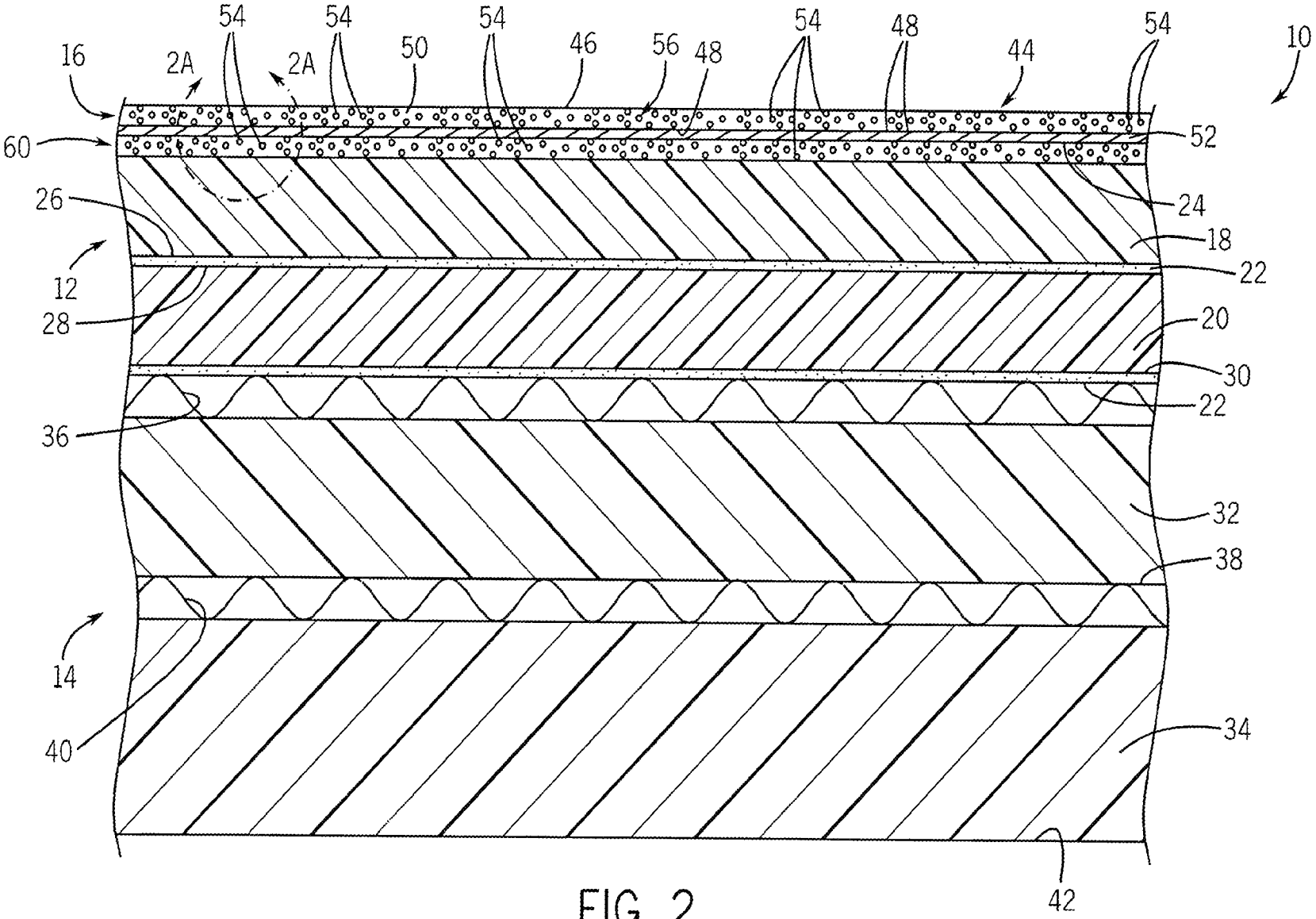
FIG. 2 is a section view of the body support cushion taken along line 2-2 of FIG. 1.

With additional reference to FIG. 2, mattress 10 according to an embodiment of the present' invention generally consists of three discrete, yet integrated components: a comfort foam system 12, a support foam system 14, and an outer cover system 16. The comfort foam system 12 includes a top comfort layer 18 comprising open-celled non-reticulated viscoelastic foam (sometimes referred to as "memory foam" or "low resilience foam") and a bottom comfort layer 20 comprising open-celled reticulated viscoelastic foam. The top comfort layer 18 and the bottom comfort layer are secured to another by adhesive or cohesive bonding material 22. In a similar manner, the bottom comfort layer 20 is secured to the support foam system 14 using a suitable bonding material 22. In one embodiment, the bonding material used to bond the two comfort layers together is the same that is used to bond the comfort foam system 12 to the support foam system 14, but the invention is not so limited. Also, other types of bonding devices may be used to secure the foam layers together. For example, the top and bottom layers 18, 20 can be bonded together by tape, hook and loop fastener material, conventional fasteners, stitches extending at least partially through the top and bottom layers 18, 20, or in any other suitable manner.

In one embodiment of the invention, the top comfort layer 18 is made of non-reticulated viscoelastic foam and the bottom comfort layer 20 is made of reticulated viscoelastic foam. In other embodiments, both of the aforementioned layers are made of reticulated viscoelastic foam. In yet other embodiments, both layers are made of non-reticulated viscoelastic foam. It is also contemplated that the top comfort layer 18 could be formed of reticulated viscoelastic foam. It is also contemplated that one or more of the comfort layers may be comprised of non-viscoelastic material.

Each of the top and bottom, layers 18, 20 can be substantially flat bodies having substantially planar top and bottom surfaces 24, 26, 28, and. 30 as shown in FIG. 2. However, in other embodiments, one or more of the top and bottom surfaces 24, 26, 28, 30 of either or both top and bottom layers 18, 20 can be non-planar, including without limitation surfaces having ribs, bumps, and other protrusions of any shape and size, surfaces having grooves, dimples, and other apertures that extend partially or fully through the respective layer 18, 20, and the like. Also, depending at least in part upon the application of the mattress 10 (i.e., the product defined by the mattress 10 or in which the mattress 10 is employed), either or both of the top and bottom layers 18, 20 can have shapes that are not flat. By way of example only, either or both layers 18, 20 can be generally wedge-shaped, can have a concave or convex cross-sectional shape, can have a combination of convex and concave shapes, can have a stepped, faceted, or other shape, can have a complex or irregular shape, and/or can have any other shape desired.

As illustrated in FIGS. 1 and 2, in one embodiment, the top comfort layer 18 provides a relatively soft and comfortable surface for a user's body or body portion (hereinafter referred to as "body"). Coupled with the slow recovery characteristic of the viscoelastic foam, the top comfort layer 18 can also conform to a user's body, thereby distributing the force applied by the user's body upon the top comfort layer 18. In some embodiments, the top comfort layer 18 has a hardness of at least about 30 N and no greater than about 175 N for desirable softness and body-conforming qualities. In other embodiments, a top comfort layer 18 having a hardness of at least about 40 N and no greater than about 160 N is utilized for this purpose. In still other embodiments, a top comfort layer 18 having a hardness of at least about 40 N and no greater than about 75 N is utilized. In one preferred embodiment, the top comfort layer 18 has a hardness of 48 N. Unless otherwise specified, the hardness of a material referred to herein is measured by exerting pressure from a plate against a sample of the material having length and width dimensions of 40 cm each (defining a surface area of the sample of material), and a thickness of 5 cm to a compression of 40% of an original thickness of the material at approximately room temperature (e.g., 21-23 Degrees Celsius), wherein the 40% compression is held for a set period of time, following the International Organization of Standardization (ISO) 2439 hardness measuring standard.

The top comfort layer 18 can also have a density providing a relatively high degree of material durability. The density of the foam in the top comfort layer 18 can also impact other characteristics of the foam, such as the manner in which the top comfort layer 18 responds to pressure, and the feel of the foam. In some embodiments, the top comfort layer 18 has a density of no less than about 25 $kg/m^3$ and no greater than about 150 $kg/m^3$. In Other embodiments, a top comfort layer 18 having a density of at least about 40 $kg/m^3$ and no greater than about 125 $kg/m^3$ is utilized. In still other embodiments, a top comfort layer 18 having a density of at least about 60 $kg/m^3$ and no greater than about 115 $kg/m^3$ is utilized. In one preferred embodiment, the top comfort layer 18 has a density of 60 $kg/m^3$.

The viscoelastic foam of the top comfort layer 18 can be selected for responsiveness to any range of temperatures. However, in some embodiments, a temperature responsiveness in a range of a user's body temperatures (or in a range of temperatures to which the mattress 10 is exposed by contact or proximity to a user's body resting thereon) can provide significant advantages. For example, a viscoelastic foam selected for the top comfort layer 18 can be responsive to temperature changes above at least about 0° C. In some embodiments, the viscoelastic foam selected for the top comfort layer 18 can be responsive to temperature changes within a range of at least about 10° C. In other embodiments, the viscoelastic foam selected for the top comfort layer 18 can be responsive to temperature changes within a range of at least about 15° C.

As used herein and in the appended claims, a material is considered "responsive" to temperature changes if the material exhibits a change in hardness of at least 1.0% measured by ISO Standard 3386 through the range of temperatures between 10 and 30 degrees Celsius.

The bottom comfort layer 20 is similar to the top comfort layer 18 in that is made of viscoelastic material. However, in a preferred embodiment, the bottom comfort layer 20, unlike the top comfort layer 18, is made of reticulated viscoelastic polyurethane foam. That is, while top comfort layer 18 and the bottom comfort layer 20 each comprise a cellular structure of flexible viscoelastic polyurethane foam in which the walls of the individual cells are substantially intact, the bottom comfort layer 20 comprises reticulated viscoelastic foam. As described in U.S. Ser. No. 11/265,410 (published as U.S. Publ. No. 2006/0288491), which is assigned to the Assignee of this application and which the disclosure thereof is incorporated herein in its entirety, the cells of reticulated foams are essentially skeletal structures in which many (if not substantially all) of the cell walls separating one cell from another do not exist. In other words, the cells are defined by a plurality of supports or "windows" and by no cell walls, substantially no cell walls, or by a substantially reduced number of cell walls. Such a cellular foam structure is sometimes referred to as "reticulated" foam. In some embodiments, a foam is considered "reticulated" if at least 50% of the walls defining the cells of the foam do not exist (i.e., have been removed or were never allowed to form. during the manufacturing process of the foam).

Also, in some embodiments it is desirable that the bottom comfort layer 20 of reticulated viscoelastic foam be capable of providing some degree of support that is substantially independent of temperatures experienced by the top comfort layer 18 when supporting a user's body (i.e., independent of a user's body heat). Therefore, it is contemplated that the bottom comfort layer 20 can comprise reticulated viscoelastic foam that is responsive to temperature changes within a range of between about 10° C. and about 35° C. In some embodiments, the bottom comfort layer 20 can comprise reticulated viscoelastic foam that is responsive to temperature changes within a range of between about 15° C. and about 30° C. In still other embodiments, the bottom comfort layer 20 comprising reticulated viscoelastic foam that is responsive to temperature changes within a range of between about 15° C. and about 25° C. can be used. It is also contemplated that the comfort layer 20 could be reticulated non-viscoelastic foam, such as reticulated high resiliency foam.

By virtue of the skeletal cellular structure of the bottom comfort layer 20, heat in the top comfort layer 18 can be transferred away from the top comfort layer 18, thereby helping to keep a relatively low temperature in the top comfort layer 18. Also, the reticulated viscoelastic foam of the bottom comfort layer 20 can enable significantly higher airflow into, out of, and through the bottom comfort layer 20—a characteristic of the bottom comfort layer 20 that can also help to keep a relatively low temperature in the top comfort layer 18. Additionally, since the bottom comfort layer 20 contains viscoelastic material, the bottom comfort layer 20 of the comfort system 12 also provides the performance benefits often associated with viscoelastic foam; namely, the distribution of force applied thereto.

Like the top comfort layer 18, the bottom comfort layer 20 can have a density providing a relatively high degree of material durability. Also, the density of the foam in the bottom comfort layer 20 can also impact other characteristics of the foam, such as the manner in which the bottom comfort layer 20 responds to pressure, and the feel of the foam. In. some embodiments, the bottom comfort layer 2) has a density of no less than about 20 kg/m$^3$ and no greater than about 130 kg/m$^3$. In other embodiments, a bottom comfort layer 20 having a density of at least about 25 kg/m$^5$ and no greater than about 150 kg/m$^3$ is utilized. In still other embodiments, a bottom comfort layer 20 having a density of at least about 30 kg/m$^3$ and no greater than about 150 kg/m$^3$ is utilized. In a preferred embodiment, the bottom comfort layer 20 has a density of 85 kg/m$^3$.

Also, in some embodiments, the bottom comfort layer 20 has a hardness or at least about 50 N and no greater than about 150 N. in other embodiments, a bottom comfort layer 20 having a hardness of at least about 40 N and no greater than about 100 N is utilized. In still other embodiments, a bottom comfort layer 20 having a hardness of at least about 40 N and no greater than about 80 N is utilized. In a preferred embodiment, the bottom comfort layer 20 has a hardness of 60 N.

In one embodiment, the mattress 10 can have a bottom comfort layer 20 that is at least as thick as the top comfort layer 18, e.g., 5 cm. However, it is contemplated that the layers 18, 20 could have different thickness. For instance, the top comfort layer 18 could have a thickness that is less than or greater than the thickness of the bottom comfort layer 20. In one embodiment, the top comfort layer 18 has a thickness of S cm and the bottom comfort layer 20 has a thickness of 0.5 cm.

In the illustrated embodiment, the support system 14 also includes two foam layers: a top support layer 32 and a bottom support layer 34. Each of the top and bottom support layers 32, 34 can be substantially flat bodies having substantially planar top and bottom surfaces or, as shown in FIG. 2, convoluted top surfaces 36, 40 and planar bottom surface 38, 42. In addition to. the illustrated convolutions, other non-planar shapes are contemplated, including without limitation, surfaces having ribs, bumps, and other protrusions of any shape and size, surfaces having grooves, dimples, and other apertures that extend partially or fully through the respective layer 32, 34, and the like. Also, by way of example only, either or both layers 32, 34 can be generally wedge-shaped, can have a concave or convex cross-sectional shape, can have a combination of convex and concave shapes, can have a stepped, faceted, or other shape, can have a complex or irregular shape, and/or can have any other shape desired.

The support layers 32, 34 are preferably made of high resiliency (HR) polyurethane foam and provide support for the support comfort system 12. Alternately, the support layers 32, 34 are made of conventional foam. Preferably the support layers 32, 34 have a minimum ball rebound of 50. The support layers 32, 34 can independently have a reticulated or non-reticulated cellular structure. It is also contemplated that the support layers may be made from other types of foams. In one embodiment, the support layers 32, 34 each have a hardness of at least about 100 N and no greater than about 300 N for desirable support. In other embodiments, support layers 32, 34 each having a hardness of at least about 125 N and no greater than about 200 N is utilized for this purpose. In still other embodiments, support layers 32, 34 each having a hardness of at least about 150 N and no greater than about 175 N is utilized. In a preferred embodiment, each support layer 32, 34 has a hardness of 150 N. Unless otherwise specified, the hardness of a material referred to herein is measured by exerting pressure from a plate against a sample of the material having length and width dimensions of 40 cm each (defining a surface area of the sample of material), and a thickness of 5 cm to a compression of 40% of an original thickness of the material at approximately room temperature (e.g., 21-23 Degrees Celsius), wherein the 40% compression is held for a set period of time, following the International Organization of Standardization (ISO) 2439 hardness measuring standard.

The support layers 32, 34 can also have a density providing a relatively high degree of material durability. The density of the foam in the support layers 32, 34 can also impact other characteristics of the foam, such as the manner in which the support layers 32, 34 responds to loading. In some embodiments, the support layers 32, 34 each has a density of no less than about 15 kg/m$^3$ and no tauter than about 150 kg/m$^3$. In other embodiments, a support layers 32, 34 each having a density of at least about 25 kg/m$^3$ and no greater than about 125 kg/m$^3$ is utilized. In still other embodiments, support layers 32, 34 each having a density of at least about 25 kg/m$^3$ and no greater than about 115 kg/m$^3$ is utilized. In one preferred embodiment, each support layer 32, 34 has a density of 25 kg/m$^3$. It is understood that the support layers 32, 34 may have different densities and. hardness values from one another. In one embodiment, the support layers are comprised of polyurethane foam similar to that described in International Patent Application PCT/US2012/022893.

In one embodiment, the mattress 10 can have a bottom support layer 34 that is at least as thick as the top support layer 32, e.g., 10.75 cm. However, it is contemplated that the layers 18, 20 could have different thickness. For instance, the top support layer 32 could have a thickness that is less than or greater than the thickness of the bottom support layer 34. In one embodiment, the top support layer 32 has a thickness of 8 cm and the bottom support layer 34 has a thickness of 10.75 cm. It will be appreciated that these thickness values are merely illustrative and that the mattress could be constructed to have layer thicknesses different from those provided above. Alternately, the support layers 32, 34 could be combined into a single layer.

Referring again to FIGS. 1 and 2, the outer cover system 16 comprises an outer cover 44 that encloses, or at least partially encloses, the comfort and support systems 12, 14, respectively. The outer cover 44 is made of fabric and, in a preferred embodiment, a combination of polyester, cotton natural yarn, and spandex. It is contemplated that other types of fabric or ticking could be used at is also contemplated that a quilted outer cover could be used. The outer cover 44 has an outer surface 46 and an inner surface 48 that are spaced from one another by at least one layer of fabric or ticking 50 that extends across the upper surface of the mattress 10 and down the sidewalls 10' of the mattress 10. The outer cover 44 fits snuggly around the mattress 10, which holds the outer cover 44 in place. Alternately, the outer cover 44 can extend completely around the mattress 10 with ends thereof being connectable, such as by a zipper, to allow removability of the outer cover 44, such as for washing. As known in the art, a fire sock 52 envelopes the comfort and support layers and, as such, the outer cover 44 fits around the fire sock 52 as well.

To provide a cool dermal sensation, the outer cover 44 is impregnated with phase change material (PCM). In a preferred embodiment, PCM is in the form of a layer of microspheres 54 that are doped onto the outer surface 46, inner surface 48, and ticking 50 of the outer cover 44 using one of a number known application techniques. For example, the PCM could be applied using a screening process. Alternately, the outer cover 44 could be passed through a PCM bath. Regardless of application technique, it is contemplated that the portion of the outer cover 44 that extends across the upper surface of the mattress 10 is substantially saturated with PCM to, in effect, form a PCM layer 56 that is coextensive with the fabric layer 50. Alternately, the PCM could be applied to the outer surface 46 of the outer cover 44 to form a PCM layer (not shown) atop the outer surface 46. In one preferred embodiment, the PCM is THERMIC™ microcapsules commercially available from Devan Chemicals of Belgium. In other embodiment, the PCM is OUTLAST® microcapsules, which is commercially available from Outlast Technologies.

Figure 2A:
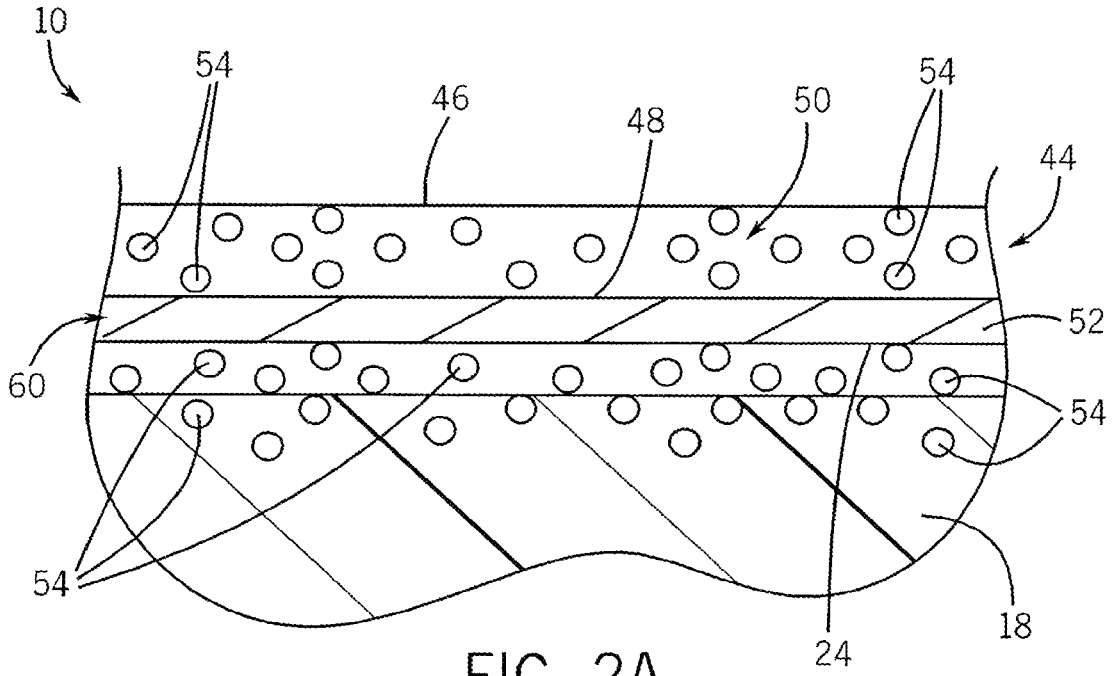
FIG. 2A is a section view of the body support cushion taken along line A-A, of FIG. 2.

With additional reference to FIG. 2A, in addition to PCM in the outer cover 44, mattress 10 also includes microspheres 54 of PCM forming a PCM layer 60 in the top comfort layer 18. The PCM microspheres 54 are preferably spray-applied to the upper surface of the top comfort layer 18 to form a PCM layer 60 having a thickness of between 500 μm and 4.0 mm, and preferably approximately 2.0 mm.

The material used to form the PCM layer 60 is similar to that applied to the outer cover 44, but it is contemplated that different types of phase change material could be used to form the respective PCM layers. Preferably, the thickness of the PCM layer 60 in the mattress is greater, or more dense, than the PCM layer 56 in the outer cover 44. That is, it is preferred that the heat capacity of the PCM layer 60 will be greater than the heat capacity of PCM layer 56.

The two PCM layers 56, 60 provide the dermal sensation of cool as well as the ability to absorb heat over an extended exposure period. As a result, as the thinner outer cover PCM layer 56 becomes saturated, i.e., heated, the latent heat characteristics of the PCM layer 60 in the top comfort layer 18 will effectively be a heat sink and thus absorb heat from the now-heated outer cover 44. This translates to an extended period by which PCM absorbs heat from the user as the .user rests upon the mattress 10, and ultimately provides a longer cooler sleeping surface, which is believed to be desirable for those that "sleep hot", For example, in one embodiment, the amount of PCM in the outer cover provides approximately 15-30 seconds of cool dermal feel whereas the amount of PCM in the top comfort layer provides cool dermal feel for up to 120 minutes. Moreover, should the ambient temperature drop below the melting point of the phase change material, the latent heat stored in the PCM will be released and thus provide some heating back to the consumer during the night.

Figure 3:
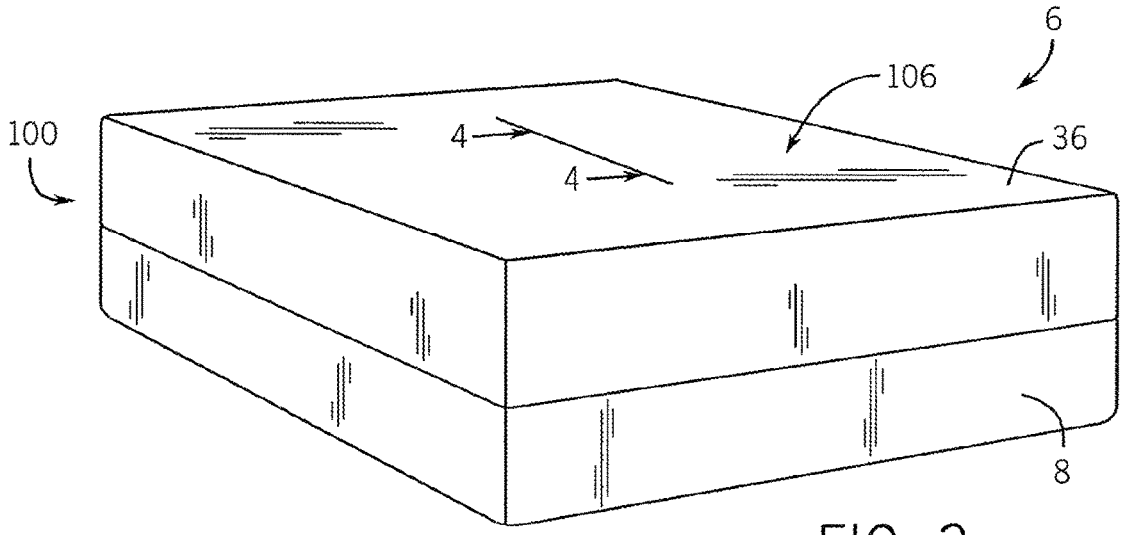
FIG. 3 is an isometric view of a body support cushion according to another embodiment of the invention.
Figure 4A:
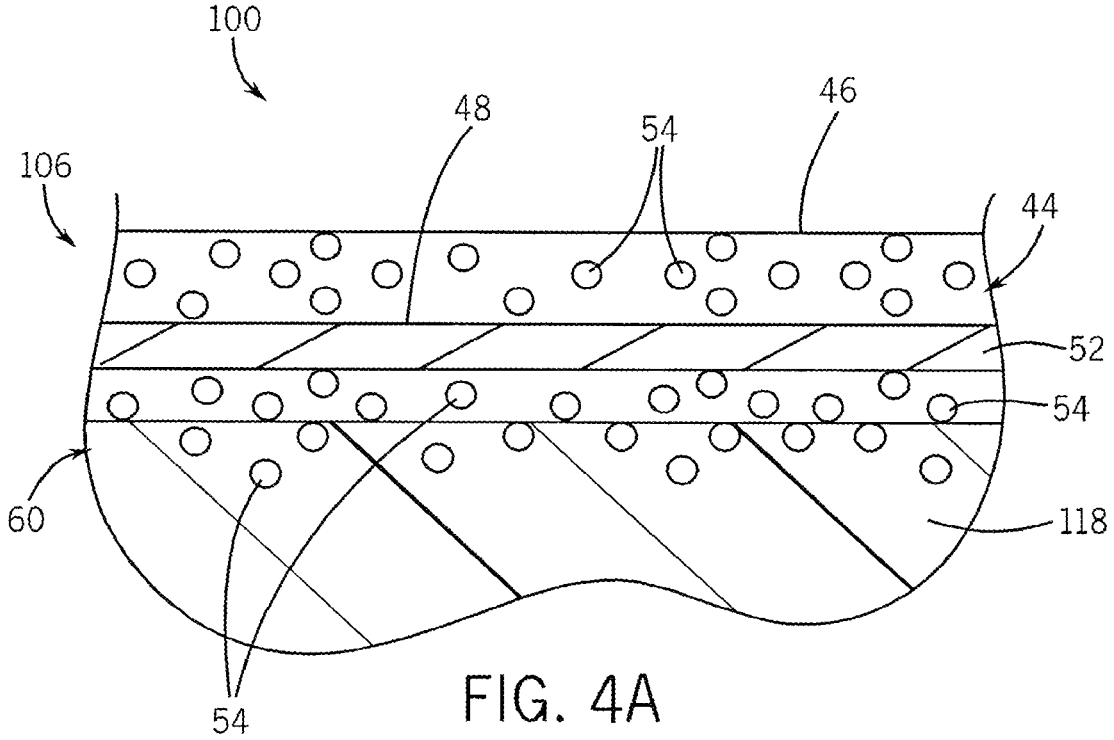
FIG. 4A is a section view of the body support cushion of FIG. 4 taken along line A-A of FIG. 4.
Figure 4:
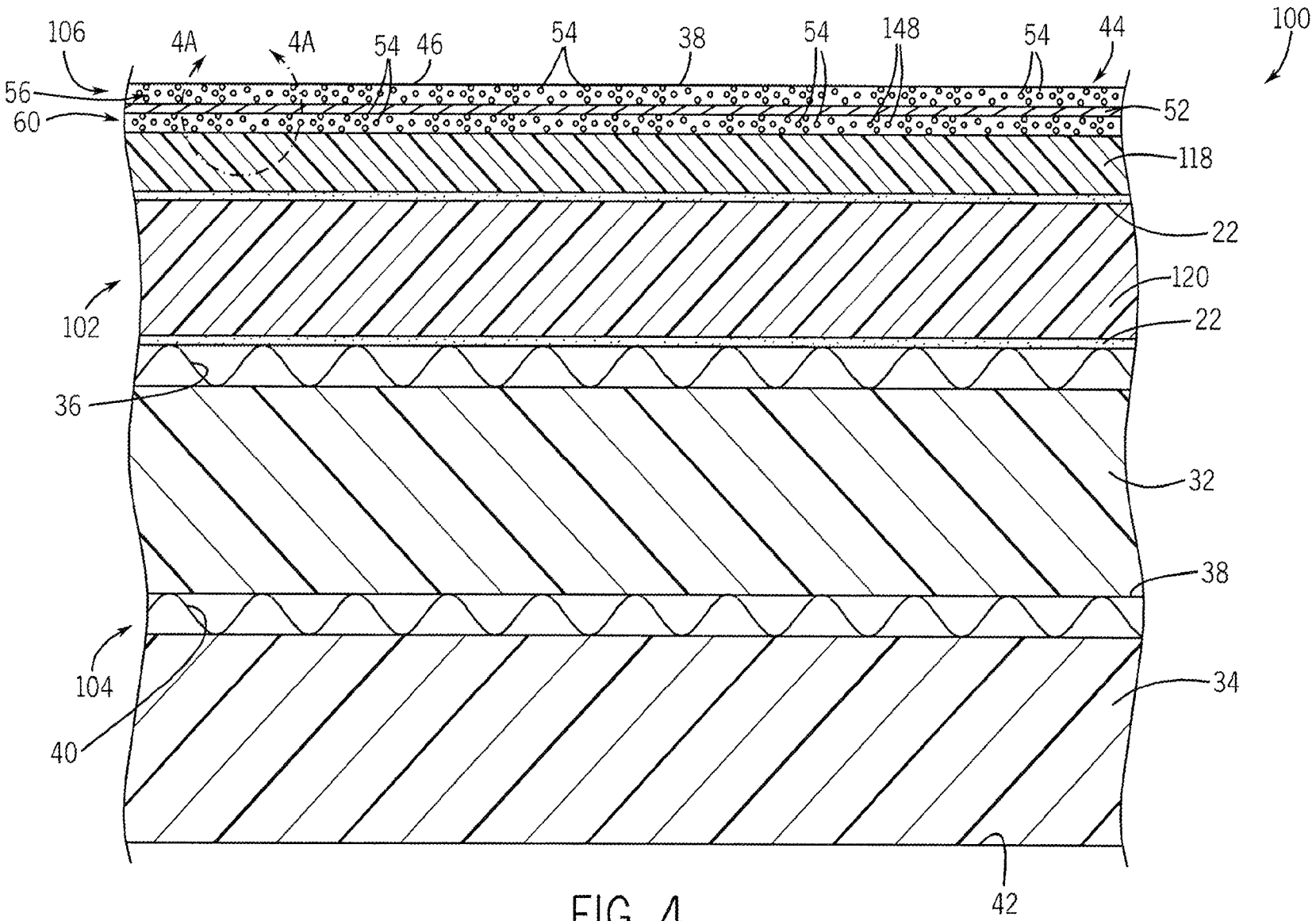
FIG. 4 is a section view of the body support cushion taken along line 4-4 of FIG. 3.

FIGS. 3 and 4 illustrate another embodiment of a body support according to the present invention. This embodiment employs much of the same structure and has many of the same properties as the embodiments of the body support described above in connection with FIGS. 1 and 2. Accordingly, the following description focuses primarily upon the structure and features that are different than the embodiments described above in connection with FIGS. 1 and 2. Reference should be made to the description above in connection with FIGS. 1 and 2 for additional information regarding the structure and features, and possible alternatives to the structure and features of the body support illustrated in FIGS. 3 and 4 and described below. Structure and features of the embodiment shown in FIGS. 3 and 4 that correspond to structure and features of the embodiment of FIGS. 1 and 2 are designated hereinafter in the 100 series of reference numbers.

Like the embodiment illustrated in FIGS. 1 and 2, the mattress 100 illustrated in FIGS. 3 and 4 has a comfort layer system 102, a support layer system 104, and an outer cover system 106. In the illustrated embodiment, the only differences between the mattress 100 of FIGS. 3 and 4 and mattress 10 of FIGS. 1 and 2 can be found in the composition of the comfort layer system 102. As such, description of FIGS. 3 and 4 will be limited to that of the comfort layer system 102. Notwithstanding these similarities between mattress 100 and mattress 10, it is understood that mattress 100 could be constructed with a different, support system and outer cover than those described with respect to mattress 10.

The comfort layer system 102 is comprised of two comfort layers 118 and 120 that are secured together using adhesive or similar bonding agent that effectively forms a bonding layer 22. The upper comfort layer 118 is formed from non-reticulated viscoelastic foam and the bottom comfort layer 120 is formed from reticulated viscoelastic foam. In a preferred embodiment, the upper comfort layer 118 has a thickness between 1-5 cm and more preferably 3 cm. The bottom comfort layer 120 has a thickness between 5-12 cm and more preferably 7 cm. The top comfort layer 118 has a density between 25 kgirn3 and 150 kg/m$^3$, and more preferably a density of 100 kg/m. The lower comfort layer 120 has a density between 25 kg/m$^3$ and 150 kg/m$^3$ and more preferably a density of 75 kg/m$^3$. The upper comfort layer 118 has a hardness between 40 N and 150 N and preferably a hardness of 55 N. The bottom comfort layer .120 has a hardness between 30 N and 150 N and preferably a hardness of 55 N. With additional reference to FIG. 4A, the upper comfort layer 118 includes microspheres 54 of PCM that effectively form a PCM layer 60 that together with PCM in the outer cover provides multiple bands or layers of PCM in the mattress 100.

In the foregoing description, the application of PCM to a layer of polyurethane foam has been described but it should be understand that the body support cushions described herein may have different or other types of layers, such as latex or spacer fabric, to which PCM may be applied. For example, a body support cushion may be constructed with a spacer fabric between the outer cover and the top foam layer and the PCM could be applied to the spacer fabric.

Additionally, in preferred embodiments of the invention, the amount of PCM that is applied to the cover and/or foam layer is substantially consistent across the surface thereof. However, it is contemplated that intentional uneven applications of the PCM could be used to efficiently deposit the PCM based on believed sleeping preferences. For instance, the amount of PCM in the cover and/or foam layer upon which a sleeper's torso would rest may exceed that found in those sections upon which a sleeper's feet are expected to rest. Similarly, less PCM could be used along the periphery of the cover and/or foam layer in expectation that most sleepers do not rest on the edge of the mattress. Furthermore, it is contemplated that a mattress having two sleeping surfaces, e.g., a left side and a right side, such as that conventionally found in queen and king sized mattresses, the amount of PCM in the cover and/or foam could be selected to provide different cooling capacities for the respective sleeping surfaces.

The present invention has been described in terms of the preferred embodiment, and it is recognized that equivalents, alternatives, and modifications, aside from those expressly stated, are possible and within the scope of the appending claims.

The invention claimed is:

1. A body support cushion, comprising:

a layered arrangement of foam comprised of an upper layer of viscoelastic comfort foam and a lower layer of viscoelastic comfort foam beneath said upper layer of viscoelastic comfort foam, wherein said upper and lower layers have a density of at least 20 kg/m3 and no more than 150 kg/m3;

a phase change material disposed in the upper layer of viscoelastic comfort foam;

said layered arrangement of foam further comprising a support system having a top support layer and a bottom support layer wherein said top support layer has at least one nonplanar portion; and, a mattress cover also comprising a phase change material (PCM) wherein the amount of PCM in one area is greater than a second area.

2. The body support cushion of claim 1, wherein said support system comprising said top and bottom support layers are of the same or differing densities.

3. The body support cushion of claim 1 wherein the bottom support layer of said support system comprises viscoelastic material having a density greater than the density of the upper layer of viscoelastic foam.

4. The body support cushion of claim 1, wherein said at least one nonplanar portion includes at least one step in a sidewall of said top support layer.

5. The body support cushion of claim 1 wherein said at least one nonplanar portion includes one of concave or convex shapes.

6. The body support cushion of claim 1 wherein the top support layer and the bottom support layer are at least one of equal height and equal hardness.

7. The body support cushion of claim 1 wherein the top support layer and the bottom support layer each has a height between 8.00-12.00 cm.

8. The body support cushion of claim 7 wherein the top support layer and the bottom support layer each has a height of 10.75 cm.

9. The body support cushion of claim 8 wherein the top and bottom support layers each has a hardness between 100 N-200 N.

10. The body support cushion of claim 9 wherein the top and bottom support layers each has a hardness of 150 N.

11. The body support cushion of claim 1 wherein the upper layer of viscoelastic comfort foam has a thickness between 2.0 and 10.0 centimeters.

12. The body support cushion of claim 11 wherein the upper layer of viscoelastic comfort foam has a height of 7.0 centimeters.

13. The body support cushion of claim 1 wherein said support system includes three layers of support foam and one of said three layers is a base layer.

14. The body support cushion of claim 1 wherein the phase change material includes a plurality of microspheres containing the phase change material.

15. The body support cushion of claim 14 wherein the plurality of microspheres are spray-applied to an upper surface of the upper layer of viscoelastic comfort foam.

16. A body support cushion, comprising:

a layered arrangement of foam comprised of at least one layer of viscoelastic comfort foam having a density of at least 20 kg/m3 and no more than 150 kg/m3, said at least one layer of viscoelastic comfort foam having a phase change material;

wherein the layered arrangement of foam includes a support system having top support layer and a bottom support layer;

one of the layers of the support system comprises one of a complex or irregular shape;

wherein an amount of phase change material is also disposed between the at least one layer of viscoelastic comfort foam and the at least one layer of the support system to provide differing cooling capacities;

a mattress cover on said layered arrangement of foam, said mattress cover having a second phase change material, and wherein amounts of said second phase change material vary along an upper surface of said mattress cover.

17. The body support cushion of claim 16 wherein the one of the top or bottom layers of the support system having a density less than the density of the other of the top or bottom layers of the support system.

18. The body support cushion of claim 16 wherein one of the top or bottom layers of the support system has a height no greater than the height of the other of the top or bottom layers of the support system.

19. A mattress comprising:

a multilayer foam arrangement comprised of a first non-reticulated viscoelastic layer, a second reticulated, viscoelastic layer, and a third non-reticulated non-viscoelastic layer;

an outer mattress cover enclosing the multilayer foam arrangement; and phase change material, contained in the multilayer foam arrangement and the outer mattress cover;

said phase change material in said outer mattress cover varying in amount along a surface to vary cooling capacity along the surface of said outer mattress cover.

* * * * *